US008684467B1

(12) United States Patent
Lee

(10) Patent No.: US 8,684,467 B1
(45) Date of Patent: Apr. 1, 2014

(54) METHOD AND APPARATUS FOR CONFIGURABLE OTTOMAN

(75) Inventor: Clifton Shao-ming Lee, Hillsborough, CA (US)

(73) Assignee: Numark Industries Company Limited, Hung Hom (CN)

( * ) Notice: Subject to any disclaimer, the term of this patent is extended or adjusted under 35 U.S.C. 154(b) by 0 days.

(21) Appl. No.: 13/385,308

(22) Filed: Feb. 13, 2012

(51) Int. Cl.
*A47C 9/00* (2006.01)

(52) U.S. Cl.
USPC ..... 297/462; 297/423.44; 297/423.46

(58) Field of Classification Search
USPC ..... 297/462, 461, 423.39, 423.41, 423.44, 297/423.46; 108/9; 248/188.6, 188.8, 248/163.1, 165, 166, 170
See application file for complete search history.

(56) References Cited

U.S. PATENT DOCUMENTS

| | | | | | |
|---|---|---|---|---|---|
| 130,494 | A * | 8/1872 | Gilbert | 108/116 |
| 164,258 | A * | 6/1875 | Burlingame | 108/9 |
| 213,512 | A * | 3/1879 | Landis | 297/338 |
| 336,156 | A * | 2/1886 | Pursell | 248/396 |
| 349,053 | A * | 9/1886 | Pursell | 248/396 |
| 412,142 | A * | 10/1889 | Walters | 108/124 |
| 663,632 | A * | 12/1900 | Mack | 297/423.46 |
| 1,030,876 | A * | 7/1912 | Derry | 108/9 |
| 1,942,603 | A * | 1/1934 | Johanson | 108/119 |
| 2,215,462 | A * | 9/1940 | Davidson, Jr. et al. | 396/656 |
| 2,600,759 | A * | 6/1952 | Gross | 248/166 |
| D170,100 | S * | 7/1953 | Torsak | D6/353 |
| 2,869,620 | A * | 1/1959 | Gleitsman | 248/397 |
| 3,119,356 | A * | 1/1964 | Sauer | 108/8 |
| 3,653,715 | A * | 4/1972 | Drabert et al. | 297/423.45 |
| 4,296,694 | A * | 10/1981 | Kobayashi | 108/116 |
| 4,991,908 | A * | 2/1991 | Krechel | 297/423.41 |
| 4,993,706 | A * | 2/1991 | Wilkinson | 482/142 |
| 5,054,144 | A * | 10/1991 | Stuart et al. | 5/648 |
| 6,941,876 | B1 * | 9/2005 | Traino | 108/6 |
| 7,647,872 | B2 * | 1/2010 | Pitchford | 108/48 |
| 7,950,338 | B2 * | 5/2011 | Smed | 108/119 |
| 8,267,477 | B1 * | 9/2012 | Appiah Finn | 297/423.41 |
| 8,408,652 | B1 * | 4/2013 | Mobley, Sr. | 297/423.44 |
| 8,414,079 | B1 * | 4/2013 | Zenoff | 297/423.46 |

* cited by examiner

*Primary Examiner* — David R Dunn
*Assistant Examiner* — Alexander Harrison
(74) *Attorney, Agent, or Firm* — Daniel Hopen

(57) ABSTRACT

Some embodiments of the present invention provide a method and apparatus for a novel configurable ottoman. The configurable ottoman comprises a pair of rear legs, a pair of leg connectors each coupled to a rear leg, a pair of stub front legs each coupled to a leg connector, a pair of hinged front legs each coupled to a stub front leg to form an ottoman frame, and a support surface coupled to the ottoman frame having the pair of rear legs coupled to the support surface and the pair of hinged front legs coupled to the support surface.

16 Claims, 5 Drawing Sheets

B–B

METHOD AND APPARATUS FOR CONFIGURABLE OTTOMAN

BACKGROUND

1. Technical Field

This disclosure generally relates to ottomans, and more particularly to an ottoman that is configurable to multiple support positions.

2. Related Art

Conventional outdoor furniture of the type intended for use on decks and patio are very popular. Manufacturers of outdoor patio furniture are constantly called upon to offer new innovative designs that provide practical, comfortable products to the consumer. Manufacturers are interested in offering the new and innovative designs for astute customers that are looking for the best.

As the outdoor patio furniture industry has developed, a popular design for chairs is to also include a foot support or ottoman. However, ottoman functions can be limited being only able to provide a leg support in a single position. Consequently, ottomans are often set aside and not used except in certain circumstances.

What is needed is an ottoman that can be configured into multiple positions for added comfort and flexibility.

SUMMARY OF INVENTION

A method and apparatus for a novel configurable ottoman are disclosed which overcome disadvantages of previous ottomans. The novel configurable ottoman can be configured in multiple positions for increased user's comfort. Accordingly, the configurable ottoman comprises a pair of rear legs, a pair of leg connectors each coupled to a rear leg, a pair of stub front legs each coupled to a leg connector, a pair of hinged front legs each coupled to a stub front leg to form an ottoman frame; and a support surface coupled to the ottoman frame having the pair of rear legs coupled to the support surface and the pair of hinged front legs coupled to the support surface.

In accordance to another embodiment of the present invention, the pair of rear legs includes a hinged coupling to the support surface and the support surface includes a pair of first detents for coupling the hinged front legs to the support surface at a first level position.

In accordance to yet another embodiment of the present invention, the support surface includes a pair of second detents for coupling the hinged front legs to the support surface at a second inclined position. The configurable ottoman affords the user of the ottoman the ability to adjust the support positions of the ottoman to the comfort desired by the user.

DETAILED DESCRIPTION

Figure 1A:
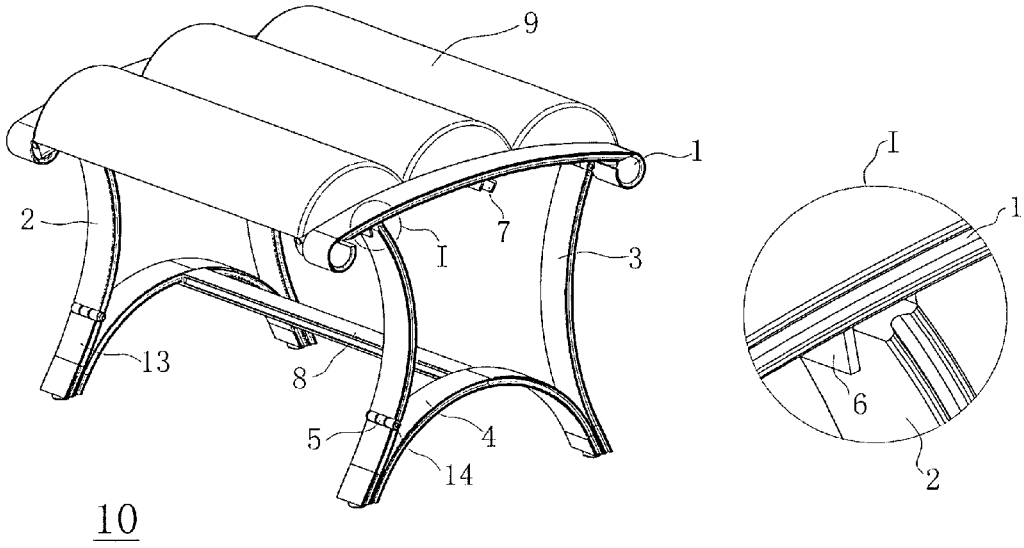
FIG. 1A illustrates a configurable ottoman in a first level position in accordance with an embodiment of the present invention.
Figure 1B:
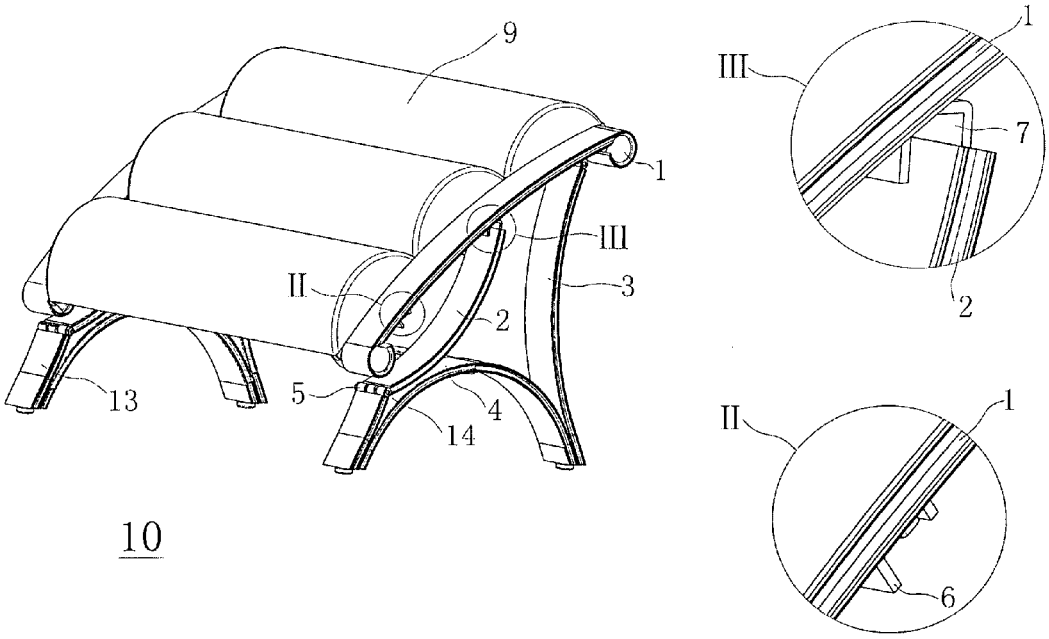
FIG. 1B illustrates the configurable ottoman in a second inclined position in accordance with an embodiment of the present invention.

FIG. 1 illustrates an ottoman 10 in accordance with an embodiment of the present invention. The ottoman 10 includes a pair of rear legs 3 coupled a pair of leg connectors 4, a pair of stub legs 13 each coupled to a leg connector 4. A cross bar 8 couples between the two leg connectors 4. The stub legs 13 each couples to front legs 2 via a hinge mechanism 5. A support surface having two support arms 1 and a cushion surface 9 couples to the two rear legs 3 and the two front legs 2. Of course, the cushion surface may be substituted with other surfaces such as non-cushion, patterned, styled, textured, and the like. The two rear legs 3 each couples to a support arm 1 via a hinge joint 5. The hinge joint 5 enables the support surface with the two support arms 1 and the cushion surface 9 to rotate about the hinge joints 5. The two front legs 2 couples to the underside of the support arms 1. The underside of the support arms 1 each includes at least one detent 6 for securing the front legs 2 to the support arms 1. Another detent 7 also positioned on the underside of the arms 1 provides another position for the front legs 2 to attach to the support surface. Referring to enlarged circled view I, the front legs 2 movable attach to the detent 6 to provide a level support surface for the ottoman 10. In accordance to an embodiment of the present invention, the detents are channel iron. Other detent configurations can be introduced by those skilled in the art and is considered to be within the spirit of the present invention. For example, the front legs may include a tang configured to mate with the underside of the support arms 1 and vice versa. As shown in FIG. 1B, the second position for the ottoman 10 tilts the support surface of the ottoman to provide an alternate support position. Referring to enlarged circled view II, detent 6 and the support arm 1 is shown in more detail. Enlarged circled view III shows the detent 7 attached to the underside of support arm 1 and engaged with the front legs 2 to provide an inclined position for the alternate support position.

Figure 2:
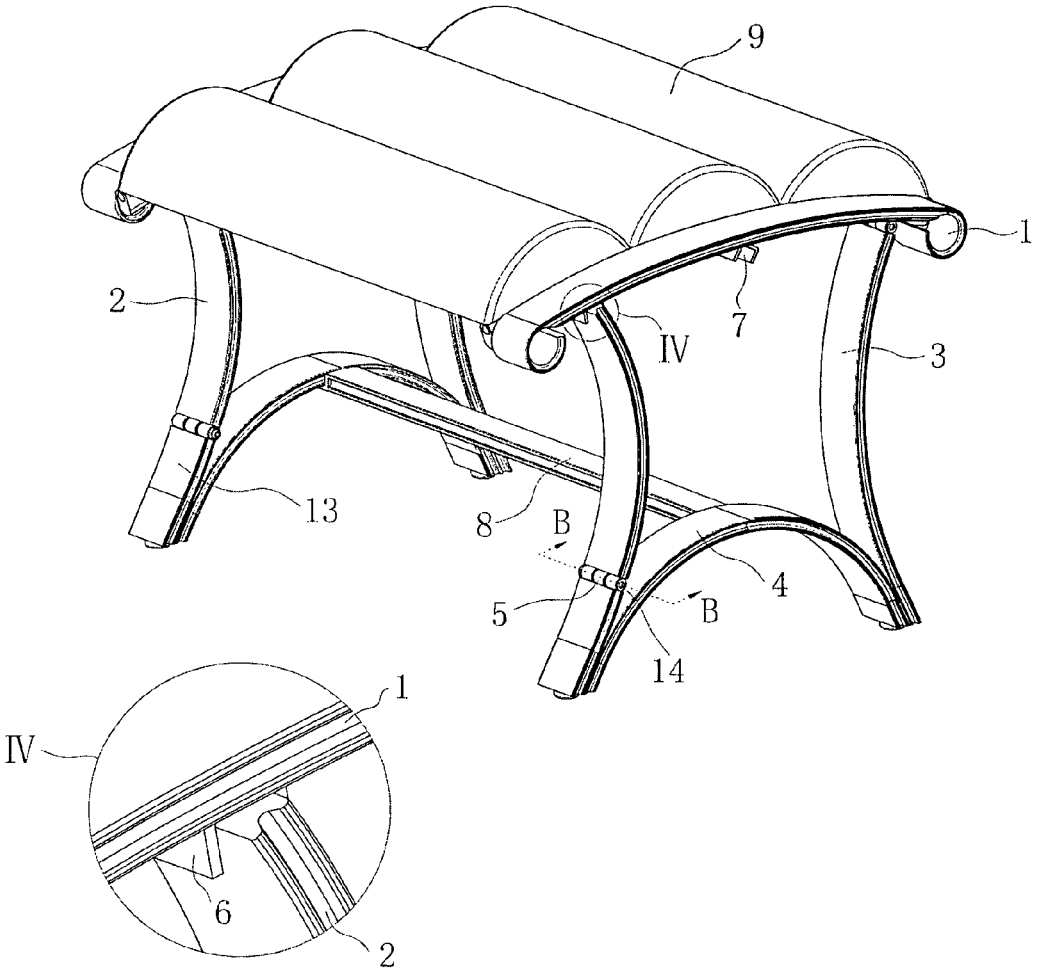
FIG. 2 illustrates the configurable ottoman and an enlarged detailed view of a hinge mechanism for the configurable ottoman in accordance with an embodiment of the present invention.
Figure 2:
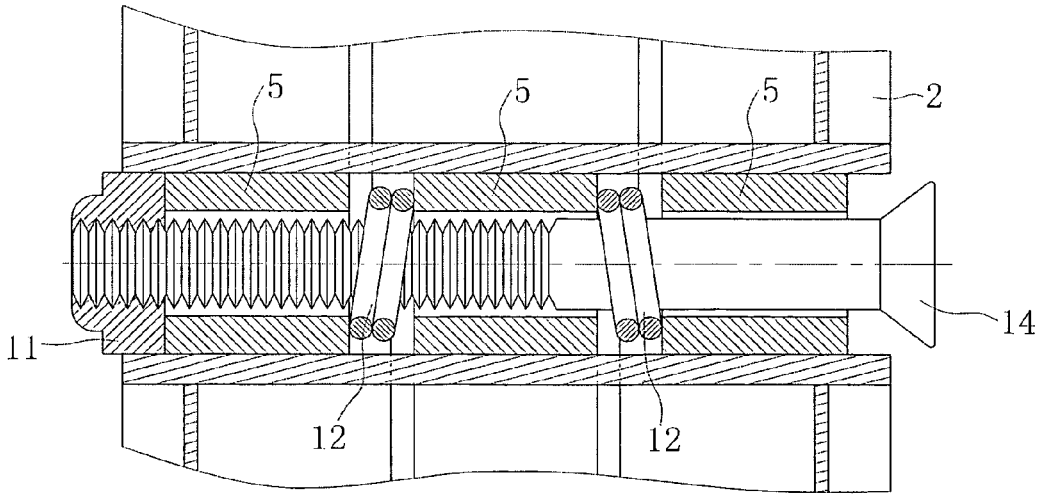

Referring to FIG. 2, the ottoman is shown in a level position with the front legs 2 engaged with the detent 6 as shown by the enlarged circle view IV. The hinge 5 is shown enlarged in a cut-away view taken along B-B. A screw 14 with two spring wire washers 12 and a nut 11 provides a rotational surface for the hinge 5. The screw and the nut are preferably substantially flush to surface so as not to protrude excessively from the hinge 5 and produce an aesthetically pleasing ottoman. According to a present embodiment of invention, there are at least 4 hinges: two hinges for attaching the two rear legs 3 to each of the two support arms 1, and two hinges for movably attaching the two front legs 2 to each of the two support arms 1 at the detents 6 or detents 7.

Figure 3A:
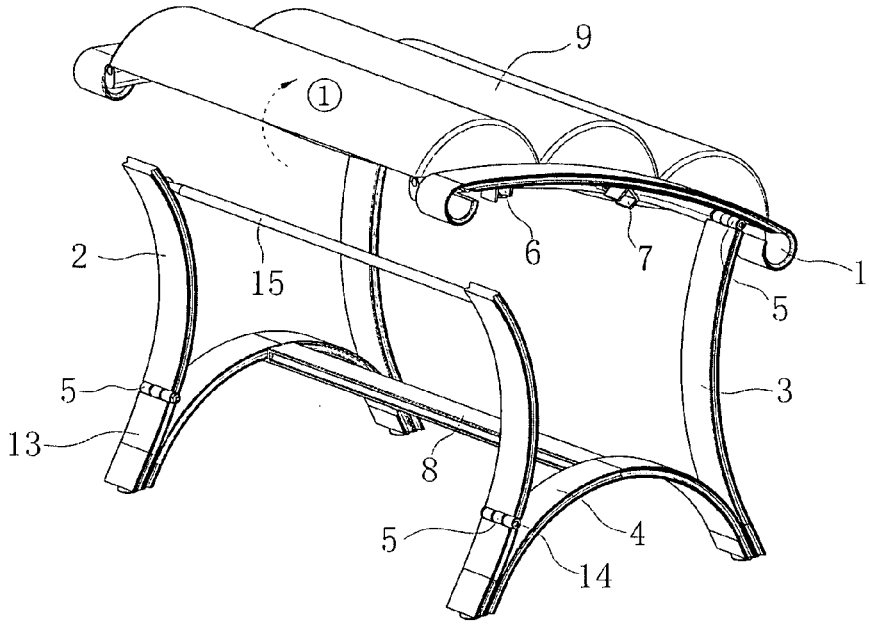
FIGS. 3A-3D illustrates the configurable ottoman being adjusted from the first level position to the second inclined position in accordance with an embodiment of the present invention.
Figure 3B:
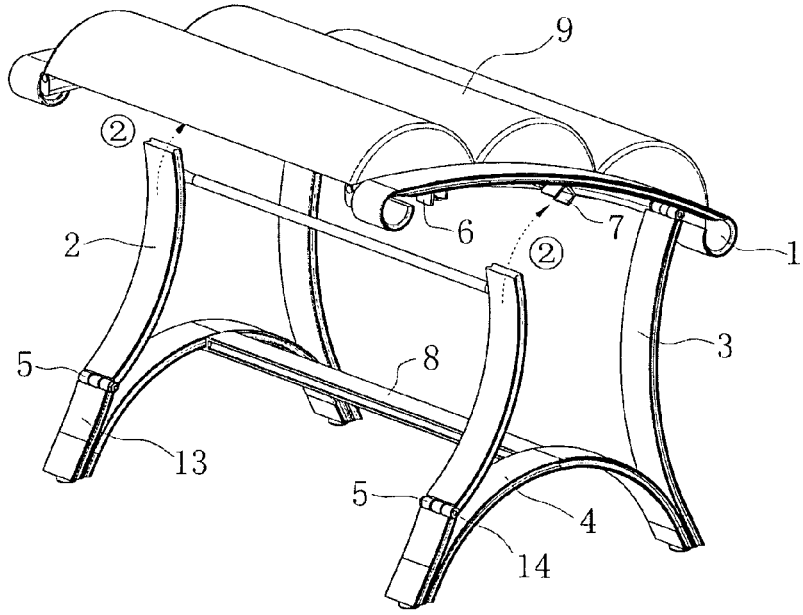
Figure 3C:
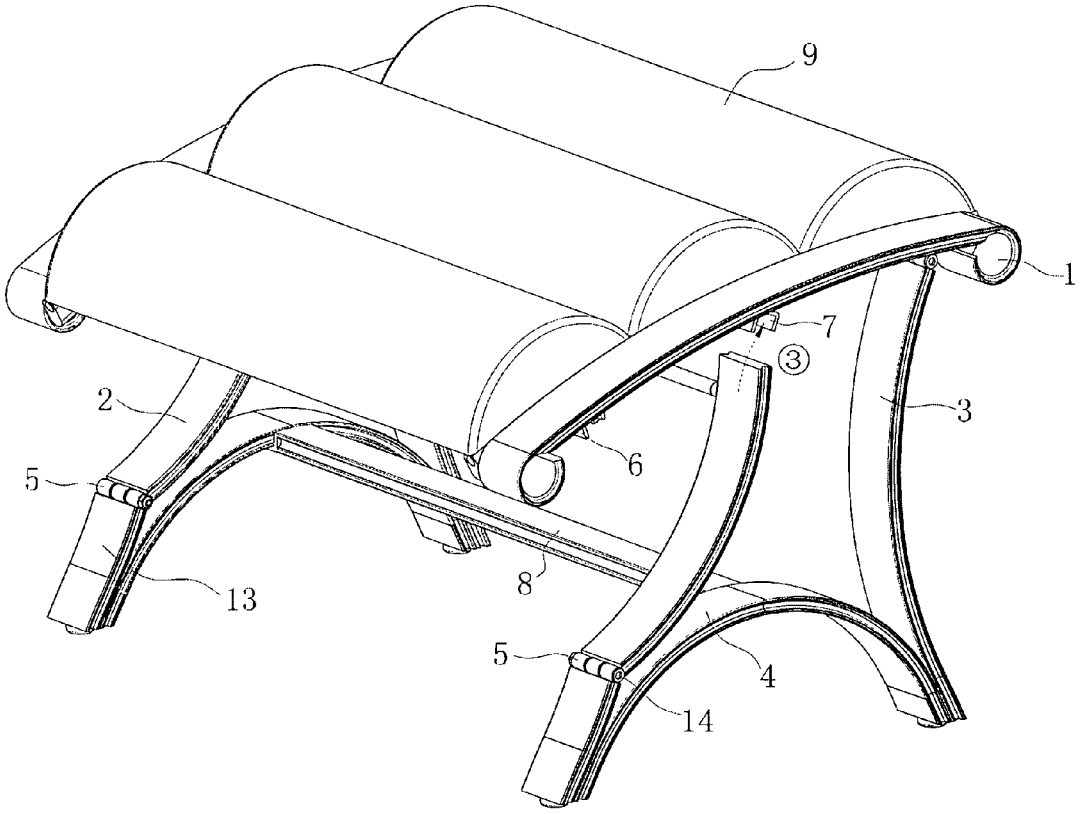
Figure 3D:
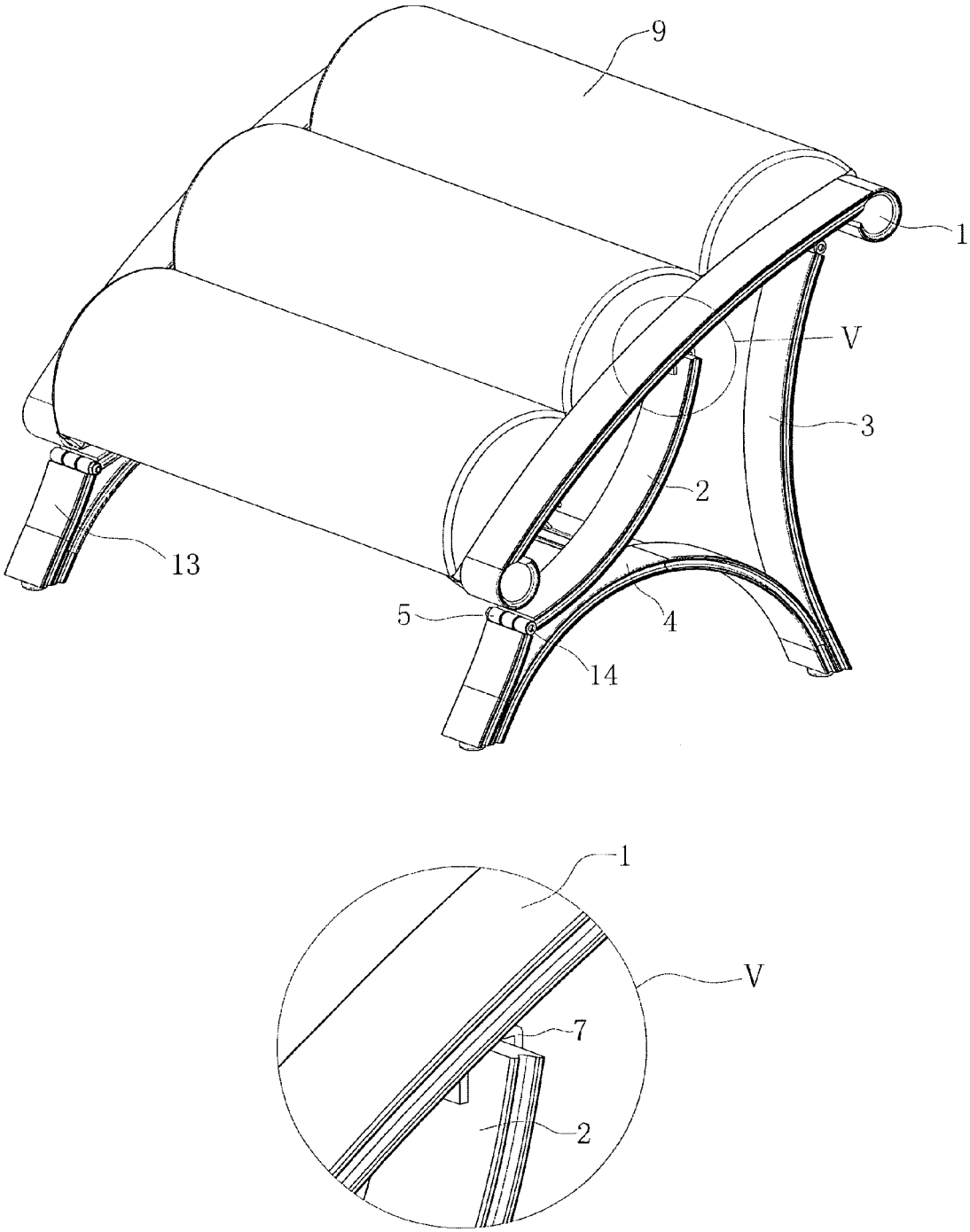

FIGS. 3A-3D shows the ottoman 10 being configured from a first flat position to a second inclined position. In FIG. 3A, the support surface with the support arms 1 and the cushion surface 9 is shown being lifted in a direction depicted by arrow 1 to disengage the detents 6 with the two front legs 2. It is noted that an upper cross support 15 is attached to the front legs 2 for added support and rigidity to the front legs 2. Referring to FIG. 3B, the front legs 2 are shown being moved towards the rear legs 3 and proximate to the detents 7 as depicted by arrows 2 while the support surface with the support arms 1 and the cushion surface 9 is raised. Referring to FIG. 3C, the front legs 2 are moved into position to be coupled with the second detent 7 as depicted by arrow 3. In FIG. 3D, the ottoman 10 is shown in the second inclined position with the front legs 2 coupled to the second detent 7. Referring to enlarged view V, a detailed view of the detent 7 coupling to the front leg 2 is shown. The front leg 2 fits into a channel slot of detent 7 to secure the support surface with the support arms 1 and the cushion surface 9 at the second inclined position. It is noted that more detents may be used to provide additional inclined positions for the ottoman 10.

The present novel ottoman is susceptible to minor variations and modifications that may be introduced without departing from the inventive concept. For example, the ottoman may be configured with different types of detents and multiple inclined positions.

It is appreciated that designation of furniture as fitting into categories such as chairs, lounges, and other separate and distinct varieties may be inadequate. For example, patio furniture as opposed to furniture designs may show no clear delineation separating the two categories.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Moreover, the above disclosure is not intended to limit the present invention. The scope of the present invention is defined by the claims.

I claim:

1. A configurable ottoman comprising:

a pair of rear legs;

a pair of leg connectors each coupled to a rear leg;

a pair of stub front legs each having a first end coupled to a leg connector and a second end having a first hinge cavity;

a pair of front legs each coupled to a stub front leg to form an ottoman frame, each front leg includes a second hinge cavity wherein the first hinge cavity mates with the second hinge cavity;

a screw assembly pair each configured to attach the first hinge cavity with the second hinge cavity to form a hinge; and a support surface coupled to the ottoman frame having the pair of rear legs coupled to the support surface and the pair of front legs coupled to the support surface.

2. The ottoman of claim 1, wherein the support surface includes a pair of first detents for coupling the front legs to the support surface at a first level position.

3. The ottoman of claim 2, wherein the support surface includes a pair of second detents for coupling the front legs to the support surface at a second inclined position.

4. The ottoman of claim 1, wherein each hinge includes a sleeve having a screw through the sleeve.

5. The ottoman of claim 4, wherein the screw includes a bolt, spring wire washer, and a nut.

6. The ottoman of claim 1 further comprising a cross bar coupled between the pair of leg connectors to provide structural support.

7. The ottoman of claim 1, wherein the support surface includes cushions to provide a soft support.

8. A foot support comprising:

a support frame having a base and four support members protruding upwards; and a platform surface hingedly coupled to two of the four support members, the platform having a set of first detents for coupling to the other two support members to provide an essentially level platform for the foot support, wherein the other two support members each include a stub leg having a first hinge cavity and a front leg having a second hinge cavity, the first hinge cavity mates with the second hinge cavity;

a screw assembly pair each configured to attach the first hinge cavity with the second hinge cavity to form a hinge; and a pair of leg connectors each coupled to the first two support members respectively; each of the stub legs having a first end coupled to one of the leg connectors and a second end having the first hinge cavity.

9. The loot support of claim 8, wherein:

the platform includes a second set of detents for coupling to the other two supports members to provide an inclined platform for the foot support.

10. The foot support of claim 9, wherein at least the other two support members are curved.

11. The foot support of claim 8, wherein the platform includes support cushions to provide a soft support surface.

12. A method of manufacturing an ottoman comprising the steps:

forming a pair of rear legs;

forming a pair of leg connectors each coupled to a rear leg;

forming a pair of stub front legs having a first end each coupled to a leg connector and a second end each having a first hinge cavity;

forming a pair of hinged front legs each having a second hinge cavity coupled to a stub front leg to form an ottoman frame wherein the first hinge cavity mates with the second hinge cavity using a screw assembly to provide a hinge; and forming a support surface coupled to the ottoman frame having the pair of rear legs coupled to the support surface and the pair of hinged front legs coupled to the support surface.

13. The method of claim 12, wherein the step of forming the support surface includes the step of hinging the support surface with the pair of rear legs.

14. The method of claim 13, wherein the step of forming the support surface includes the step of forming a pair of first detents for coupling the hinged front legs to the support surface at a first level position.

15. The method of claim 14, wherein the step of forming the support surface includes the step of forming a pair of second detents form coupling the hinged front legs to the support surface at a second inclined position.

16. The method of claim 12 further comprising the step of cushioning the support surface.

* * * * *